US008845351B2

(12) United States Patent
Johnson et al.

(10) Patent No.: US 8,845,351 B2
(45) Date of Patent: Sep. 30, 2014

(54) CONNECTOR HOUSING WITH ALIGNMENT GUIDANCE FEATURE

(75) Inventors: Lewis R. Johnson, Dover, PA (US); Steven E. Minich, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 201 days.

(21) Appl. No.: 13/420,681

(22) Filed: Mar. 15, 2012

(65) Prior Publication Data

US 2012/0258633 A1 Oct. 11, 2012

Related U.S. Application Data

(60) Provisional application No. 61/516,807, filed on Apr. 8, 2011.

(51) Int. Cl.

| | |
|---|---|
| ***H01R 13/28*** | (2006.01) |
| ***H01R 13/64*** | (2006.01) |
| ***H01R 13/46*** | (2006.01) |
| ***H01R 13/405*** | (2006.01) |

(52) U.S. Cl.

CPC ..... *H01R 13/46* (2013.01); *H01R 13/64* (2013.01); *H01R 13/405* (2013.01)

USPC ..... 439/284

(58) Field of Classification Search

CPC ..... H01R 23/27

USPC ..... 439/74, 284, 285, 680, 293, 295, 374, 439/353

See application file for complete search history.

(56) References Cited

U.S. PATENT DOCUMENTS

| | | | | |
|---|---|---|---|---|
| 3,676,833 | A | 7/1972 | Johnson | 339/49 |
| 3,732,525 | A | 5/1973 | Henschen et al. | 339/49 |
| 4,082,397 | A | 4/1978 | Tanaka et al. | 339/49 |
| 5,098,311 | A * | 3/1992 | Roath et al. | 439/295 |
| 5,161,985 | A * | 11/1992 | Ramsey | 439/74 |
| 5,487,677 | A | 1/1996 | Hoffner | 439/293 |
| 5,567,166 | A * | 10/1996 | Lemke | 439/74 |
| 5,613,881 | A * | 3/1997 | Ichida et al. | 439/680 |
| 5,888,101 | A * | 3/1999 | Dent et al. | 439/680 |
| 6,540,529 | B1 * | 4/2003 | Yu | 439/74 |
| 6,869,292 | B2 | 3/2005 | Johnescu et al. | 439/74 |
| 6,926,539 | B2 * | 8/2005 | Zaderej et al. | 439/74 |
| 7,309,239 | B2 * | 12/2007 | Shuey et al. | 439/74 |
| 7,553,182 | B2 * | 6/2009 | Buck et al. | 439/378 |
| 7,635,278 | B2 | 12/2009 | Shuey et al. | 439/371 |
| 7,785,152 | B2 * | 8/2010 | Yi et al. | 439/660 |
| 7,976,326 | B2 * | 7/2011 | Stoner | 439/295 |
| 8,147,268 | B2 * | 4/2012 | Shuey et al. | 439/371 |
| 8,277,241 | B2 * | 10/2012 | Horchler et al. | 439/295 |
| 8,485,831 | B2 * | 7/2013 | Cipolla et al. | 439/74 |
| 2010/0055988 | A1 | 3/2010 | Shuey et al. | 439/660 |
| 2012/0258633 | A1 * | 10/2012 | Johnson et al. | 439/660 |

* cited by examiner

*Primary Examiner* — Neil Abrams
(74) *Attorney, Agent, or Firm* — Harrington & Smith

(57) ABSTRACT

An electrical connector housing including a contact locating area for locating electrical contacts; and a mating connector area configured to receive portions of a housing of a mating electrical connector. The mating connector area comprises a first wall forming a first area adjacent the contact locating area, and a second wall adjacent the contact locating area forming a second area separated from the contact locating area by the second wall. The first area and the second wall have a substantially same size and shape.

19 Claims, 5 Drawing Sheets

CONNECTOR HOUSING WITH ALIGNMENT GUIDANCE FEATURE

CROSS-REFERENCE TO RELATED APPLICATION

This application claims the benefit under 35 USC 119(e) of U.S. Provisional Patent Application No. 61/516,807, filed Apr. 8, 2011, which is hereby incorporated by reference in its entirety.

BACKGROUND

1. Technical Field

The exemplary and non-limiting embodiment relates generally to an electrical connector and, more particularly, to a housing of an electrical connector.

2. Brief Description of Prior Developments

U.S. patent publication No. 2010/0055988 A1 discloses mating connector housings with sidewall and recesses for orientation mating. U.S. Pat. No. 6,869,292 B2 discloses an electrical connector housing with key projections at corners and a mating electrical connector housing with key recesses at corners.

SUMMARY

The following summary is merely intended to be exemplary. The summary is not intended to limit the scope of the claims.

In accordance with one aspect, an electrical connector housing is provided including a contact locating area for locating electrical contacts; and a mating connector area configured to receive portions of a housing of a mating electrical connector. The mating connector area comprises a first wall forming a first area adjacent the contact locating area, and a second wall adjacent the contact locating area forming a second area separated from the contact locating area by the second wall. The first area and the second wall have a substantially same size and shape.

In accordance with another aspect, an electrical connector housing is provided comprising a contact locating area for locating electrical contacts; and a mating connector area configured to receive portions of a housing of a mating electrical connector. The mating connector area comprises a first wall forming a first area adjacent the contact locating area and a second wall forming a second area Separated from the contact locating area by the second wall. The first area has an outwardly extending recess into a first corner of the first wall. The second wall has a first corner with an outwardly extending projection.

In accordance with another aspect, a method comprises inserting a portion of a first connector housing into a first mating connector area of a second connector housing; and inserting a portion of the second connector housing into a second mating connector area of the first connector housing, where the first mating connector area comprises a first wall forming a first area adjacent a first contact locating area of the first connector housing and a second wall forming a second area separated from the first contact locating area by the second wall, where the second mating connector area comprises a third wall forming a third area adjacent a second contact locating area of the second connector housing and a fourth wall forming a fourth area separated from the second contact locating area by the fourth wall, and where the first and second mating connection areas have a substantially same size and shape.

BRIEF DESCRIPTION OF THE DRAWINGS

The foregoing aspects and other features are explained in the following description, taken in connection with the accompanying drawings, wherein.

DETAILED DESCRIPTION OF EMBODIMENT

Figure 1:
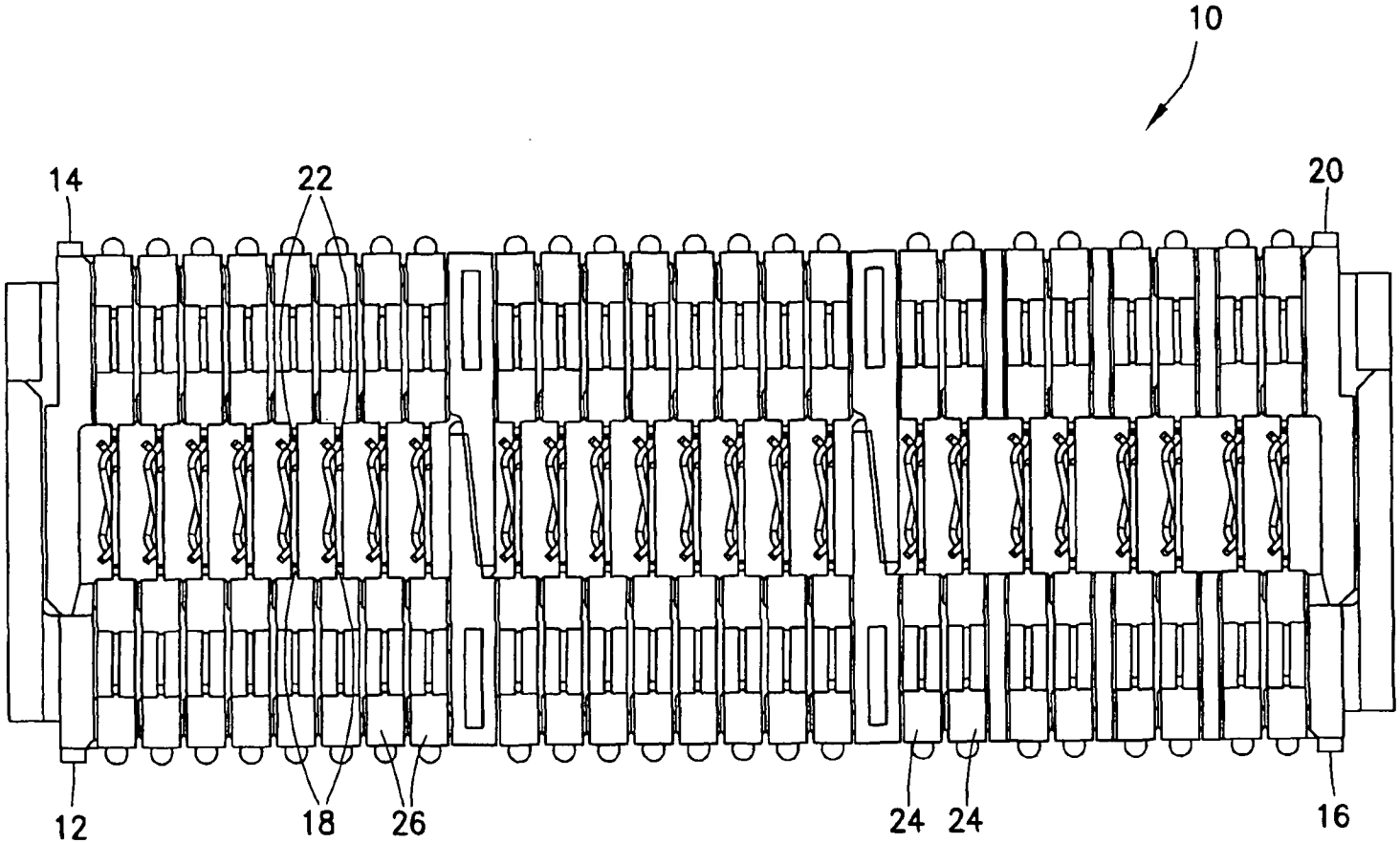
FIG. 1 is a cross sectional view of two mated electrical connectors comprising an example embodiment.

Referring to FIG. 1, there is shown a cross sectional view of an electrical connector assembly 10 incorporating features of an example embodiment. Although the features will be described with reference to the example embodiment shown in the drawings, it should be understood that features can be embodied in many alternate forms of embodiments. In addition, any suitable size, shape or type of elements or materials could be used.

The assembly 10 generally comprises a first electrical connector 12 and a mated second electrical connector 14. The first electrical connector 12 comprises a housing 16 and electrical contacts or terminals 18. The second electrical connector 14 comprises a housing 20 and electrical contacts or terminals 22.

Figure 2:
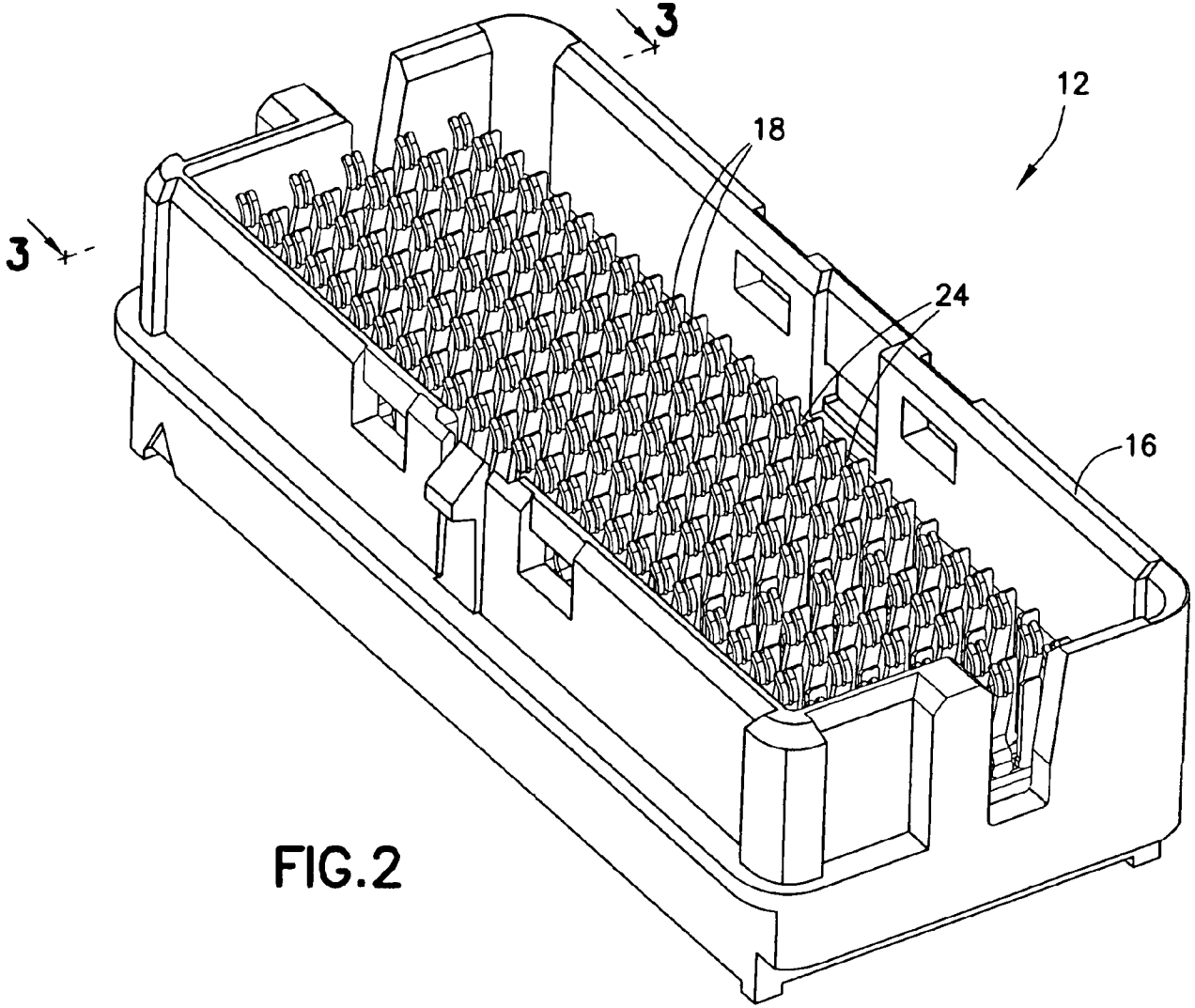
FIG. 2 is a perspective view of one of the electrical connectors shown in FIG. 1.
Figure 3:
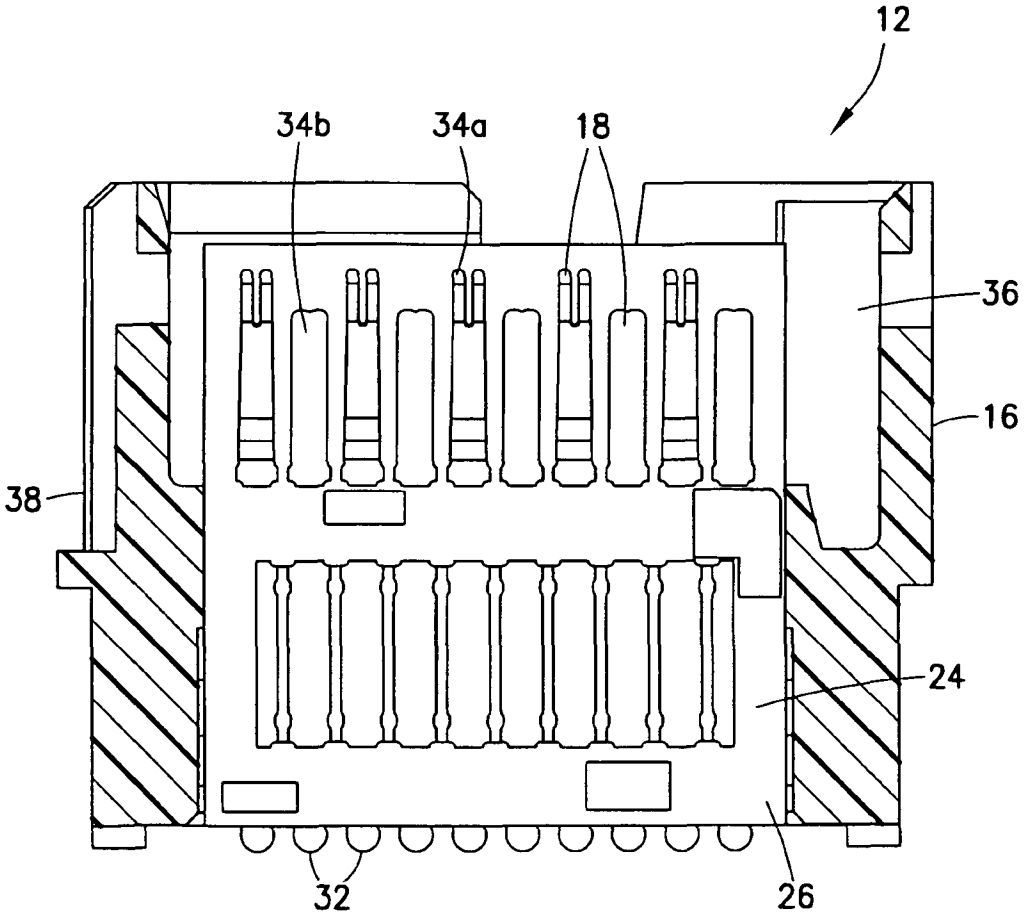
FIG. 3 is a cross sectional view of the connector shown in FIG. 2 taken along line 3-3.

Referring also to FIGS. 2-3, in this example embodiment the contacts 18 of the first connector 12 are provided in multiple Insert Molded Leadframe Assemblies (IMLAs) 24. Examples of IMLAs are described in U.S. Pat. No. 6,869,292 B2 and U.S. patent publication No. 2010/0055988 A1 which are hereby incorporated by reference in their entireties. However, in alternate embodiments, the first connector 12 might not use IMLAs. The IMLAs in this example embodiment comprise a plurality of the contacts 18 aligned in a row and a plastic overmolded frame 26. The frame 26 keeps the row of contacts 18 together for easy assembly into the housing 16. The contacts 18, in this example, comprise two different types of contacts with different mating contact ends 34*a*, 34*b*. However, any suitable type of mating contact ends could be provided, or any number of different contacts could be provided including just one type or more than two types. In this example embodiment the IMLAs also comprise fusible elements 32. The fusible elements 32 are connected to ends of the contacts 18 for electrically and mechanically connecting the connector 16 to another component, such as a printed circuit board for example.

Figure 4:
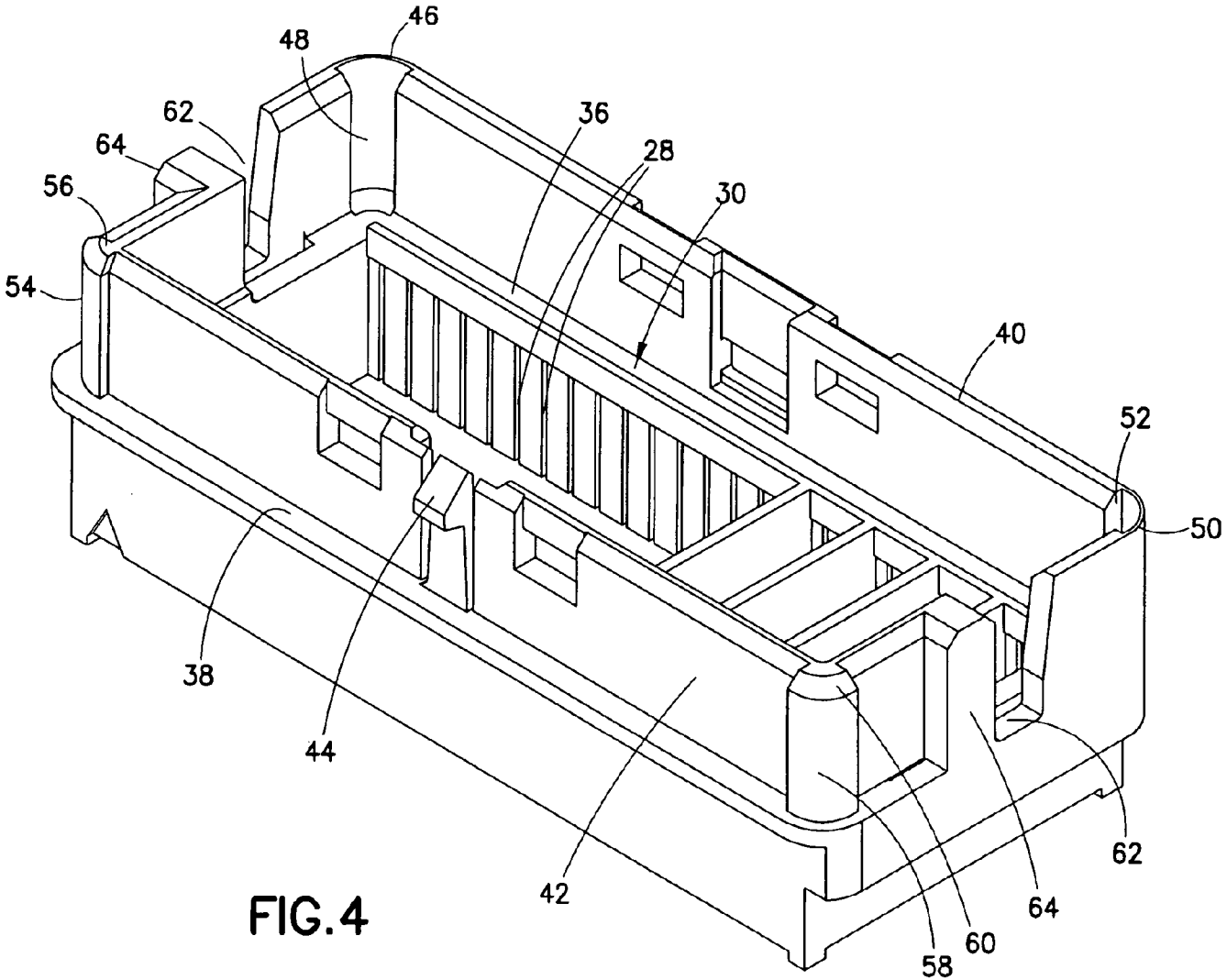
FIG. 4 is a perspective view of the housing shown in FIG. 2.

Referring also to FIG. 4, the housing 16 comprises a contact locating area 30. The contact locating area 30 is configured to have the IMLAs mounted therein. In this example embodiment the locating area 30 comprises slots 28 for receiving lateral ends of the frames 26 to thereby mount the IMLAs to the housing 16. However, any suitable mounting system could be provided.

The housing 16 is comprised of molded plastic or polymer material. In addition to the contact locating area 30, the housing 16 comprises a mating connector area configured to receive portions of the housing 20 of the second connector 14. In this example embodiment the mating connector area comprises two areas 36, 38. However, more than two areas could be provided. The mating connector area comprises a first wall 40 forming the first area 36 adjacent the contact locating area 30, and a second wall 42 adjacent the contact locating area 30 forming the second area 38. The second area 38 is separated from the contact locating area 30 by the second wall 42. The first area 36 and the second wall 42 have a substantially same size and shape. However, the second wall 42 has a deflectable latch 44 for latching with the housing 20 of the second connector 14.

The first area 36 comprises a general elongated "U" shape in this example embodiment. The first area 36 comprises a first corner 46 having an outwardly extending recess 48, and a second corner 50 having an outwardly extending recess 52. The second wall 42 comprises a first corner 54 having a first outwardly extending projection 56 into the second area 38, and a second corner 58 with a second outwardly extending projection 60. The recesses 48, 52 have a general quarter circle shape, and the projections 56, 60 have a general quarter circle shape. The second area 38 is essentially an inverse of the first wall 40. Likewise, the second wall 42 is essentially an inverse of the first area 36. In this example embodiment the two walls 40, 42 are separated by two slots 62 at opposite ends of the housing. The second wall 42 has two projections 64 at opposite ends of the housing.

Figure 5:
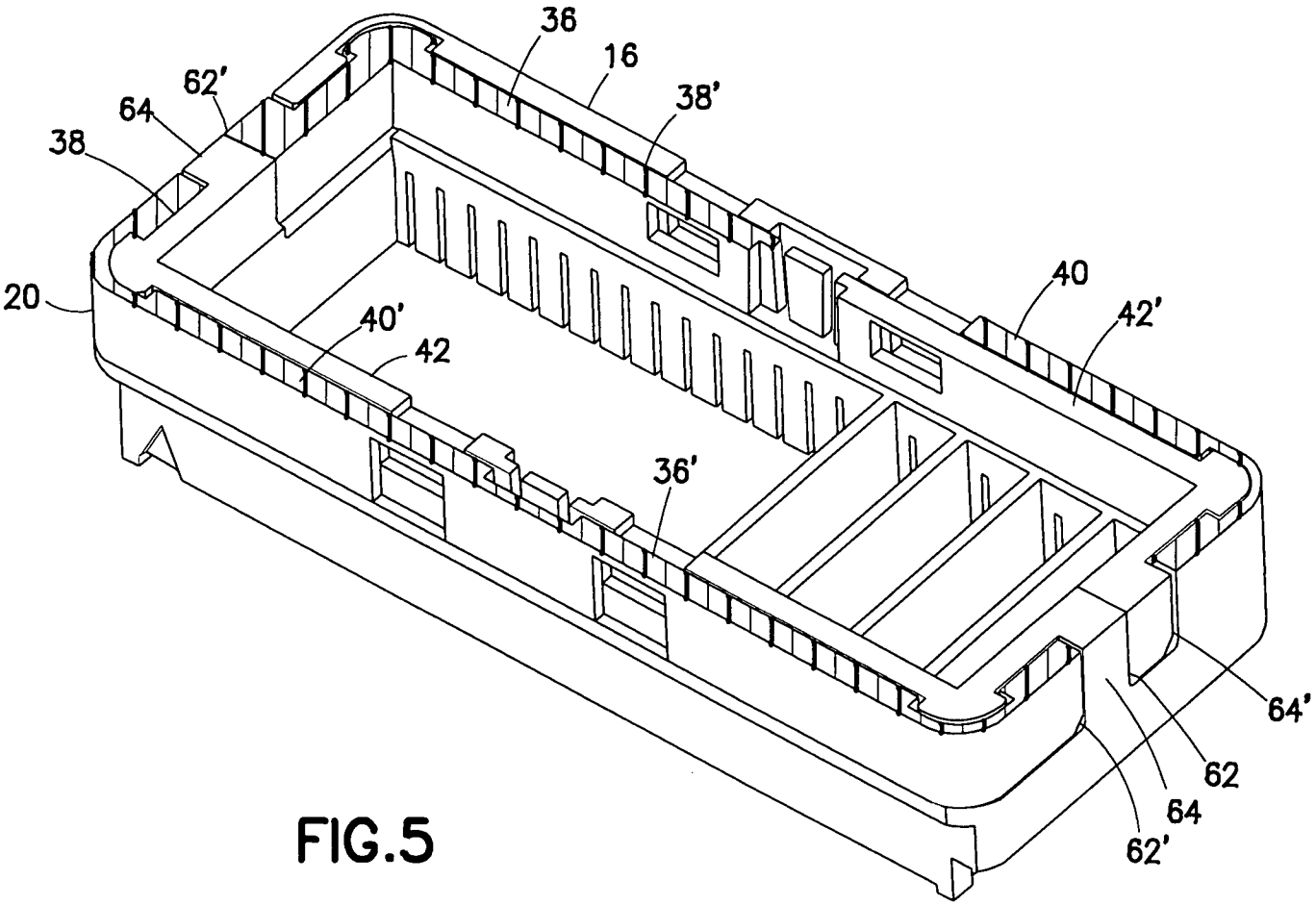
FIG. 5 is a perspective view of the housing as shown in FIG. 4 with a cut away section of the housing of the mating electrical connector shown attached thereto.

Referring also to FIG. 5, the first housing 16 is shown with a cut-away section of the second housing 20 of the mating connector 14. The second housing 20 has a mating connector area configured to receive portions of the housing 16 of the first connector 12. The mating connector area of the second housing 20 comprises a first wall 40' forming the first area 36' adjacent its contact locating area, and a second wall 42' adjacent its contact locating area forming a second area 38'. The second area 38' is separated from the contact locating area of the second connector housing by the second wall 42'.

The two first walls 40, 40' have a same size and shape. The two second walls 42, 42' have a same size and shape. The two first areas 36, 36' have a same size and shape. The two second areas 38, 38' have a same size and shape. However, the two mating connector areas are flipped relative to each other in order to be mated. Thus, when mated the first wall 40 is located in the second area 38'. The first wall 40' is located in the second area 38. The second wall 42 is located in the first area 36'. The second wall 42' is located in the first area 36. The projections 64 are received in the slots 62', and the projections 64' are located in the slots 62. The mating connector area 30 of the first connector is hermaphroditic; having matingly shaped male and female sections. Likewise, the mating connector area of the second connector is hermaphroditic; having matingly shaped male and female sections. The two hermaphroditic mating connection areas mate with each other.

The example embodiment described above can provide a hermaphroditic guide concept such that one housing has both male and female components. These features provide resistance to excessive mating/unmating angles as well as provide more precise alignment early on during mating of the two electrical connectors. In particular, the shape of the projections 56, 58 at the corners, and the shape of the recesses 48, 52 at the corners, and the fact that both of the housings 16, 20 have these features, provide enhanced projection/recess alignment features during mating to resist excessive angles between the housings 16, 20 during mating and un-mating, as well as provide more precise alignment early on during mating of the two electrical connectors. This can provide less risk of damage to the contact ends 34*a*, 34*b*. This may be particularly important if the contact ends 34*a*, 34*b* are very small; and thus more prone to being easily damaged.

An example embodiment may comprises an electrical connector housing including a contact locating area for locating electrical contacts; and a mating connector area configured to receive portions of a housing of a mating electrical connector, where the mating connector area comprises a first wall forming a first area adjacent the contact locating area, and a second wall adjacent the contact locating area forming a second area separated from the contact locating area by the second wall. The first area and the second wall may have a substantially same size and shape.

The contact locating area may be configured to receive a plurality of Insert Molded Leadframe Assemblies (IMLAs). The first area may comprise a first corner having an outwardly extending recess. The first area may comprise a second corner having an outwardly extending recess. The second wall may comprise a first corner having a first outwardly extending projection into the second area. The second wall may comprise a first corner having a first outwardly extending projection into the second area. The second wall may comprise a second corner having a second outwardly extending projection into the second area. The first wall may comprise a corner having a general quarter circle recess, and the second wall may comprises a corner having a general quarter circle projection. An assembly may comprise a first electrical connector comprising an electrical connector housing as described above; and a second electrical connector adapted to be connected to the first electrical connector, where the second electrical connector comprises a second electrical connector housing including a second contact locating area for locating electrical contacts; and a second mating connector area configured to receive the mating connection area of the housing of the first electrical connector, where the mating connection areas have a same size and shape.

An example embodiment may comprise an electrical connector housing including a contact locating area for locating electrical contacts; a mating connector area configured to receive portions of a housing of a mating electrical connector, where the mating connector area comprises a first wall forming a first area adjacent the contact locating area and a second wall forming a second area separated from the contact locating area by the second wall. The first area may have an outwardly extending recess into a first corner of the first wall, and where the second wall has a first corner with an outwardly extending projection. The first area and the second wall may have a substantially same size and shape. The contact locating area may be configured to receive a plurality of Insert Molded Leadframe Assemblies (IMLAs). The first area may comprise a second corner having an outwardly extending recess into the first wall. The second wall may comprise a second corner having a second outwardly extending projection into the second area. The recess may have a general quarter circle shape, and the projection may have a general quarter circle shape.

A method may comprise inserting a portion of a first connector housing into a first mating connector area of a second connector housing; and inserting a portion of the second connector housing into a second mating connector area of the first connector housing, where the first mating connector area comprises a first wall forming a first area adjacent a first contact locating area of the first connector housing and a second wall forming a second area separated from the first contact locating area by the second wall, where the second mating connector area comprises a third wall forming a third area adjacent a second contact locating area of the second connector housing and a fourth wall forming a fourth area separated from the second contact locating area by the fourth wall, where the first and second mating connection areas have a substantially same size and shape.

Inserting the portion of the first connector housing into the first mating connector area of the second connector housing and inserting the portion of the second connector housing into the second mating connector area of the first connector housing may comprises the fourth wall having a corner with an outwardly extending projection into the fourth area which is inserted into an outwardly extending recess into a corner of the first wall.

Inserting the portion of the first connector housing into the first mating connector area of the second connector housing and inserting the portion of the second connector housing into the second mating connector area of the first connector housing may comprise the second wall having a corner with an outwardly extending projection into the second area which is inserted into an outwardly extending recess into a corner of the third wall.

Inserting the portion of the first connector housing into the first mating connector area of the second connector housing and inserting the portion of the second connector housing into the second mating connector area of the first connector housing may comprise the fourth wall having outwardly extending projections into the fourth area at two of its corners which are inserted into outwardly extending recesses into two corners of the first wall; and the second wall having outwardly extending projections into the second area at two of its corners which are inserted into outwardly extending recesses into two corner of the third wall.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An electrical connector housing comprising:

a contact locating area for locating electrical contacts; and a mating connector area configured to receive portions of a housing of a mating electrical connector, where the mating connector area comprises a first wall forming a first area adjacent the contact locating area, and a second wall adjacent the contact locating area forming a second area, where the second area is separated from the contact locating area by the second wall, where the first area and the second wall have a substantially same size and shape, where the first area comprises a first corner having an outwardly extending recess, and where the second wall comprises a first corner having a first outwardly extending projection, where the projection is located in the second area.

2. An electrical connector housing as in claim 1 where the contact locating area is configured to receive a plurality of Insert Molded Leadframe Assemblies (IMLAs).

3. An electrical connector housing as in claim 1 where the first area comprises a second corner having an outwardly extending recess.

4. An electrical connector housing as in claim 1 where the second wall comprises a second corner having a second outwardly extending projection into the second area.

5. An electrical connector housing as in claim 1 where the first wall comprises a corner having a general quarter circle recess, and where the second wall comprises a corner having a general quarter circle projection.

6. An assembly comprising:

a first electrical connector comprising an electrical connector housing as in claim 1; and a second electrical connector adapted to be connected to the first electrical connector, where the second electrical connector comprises a second electrical connector housing comprising;

a second contact locating area for locating electrical contacts; and a second mating connector area configured to receive the mating connection area of the housing of the first electrical connector, where the mating connection areas have a same size and shape.

7. An electrical connector housing as in claim 1 where a portion of the second area of the mating connector area surrounds the projection.

8. An electrical connector housing comprising:

a contact locating area for locating electrical contacts;

a mating connector area configured to receive portions of a housing of a mating electrical connector, where the mating connector area comprises a first wall forming a first section of the mating electrical connector area which is located adjacent the contact locating area and a second wall forming a second section of the mating electrical connector area, where the second section of the mating electrical connector area is separated from the contact locating area by the second wall, where the first section has an outwardly extending recess into a first corner of the first wall, and where the second wall has a first corner with an outwardly extending projection, where the projection extends into the second section of the mating electrical connector area.

9. An electrical connector housing as in claim 8 where the first section and the second wall have a substantially same size and shape.

10. An electrical connector housing as in claim 8 where the contact locating area is configured to receive a plurality of Insert Molded Leadframe Assemblies (IMLAs).

11. An electrical connector housing as in claim 8 where the first section comprises a second corner having an outwardly extending recess into the first wall.

12. An electrical connector housing as in claim 11 where the second wall comprises a second corner having a second outwardly extending projection, where second outwardly extending projection extends into the second section of the mating connector area.

13. An electrical connector housing as in claim 8 where the recess has a general quarter circle shape, and where the projection has a general quarter circle shape.

14. An electrical connector housing as in claim 8 where a portion of the second section of the mating connector area surrounds the projection.

15. An assembly comprising:

a first electrical connector comprising an electrical connector housing as in claim 8; and a second electrical connector adapted to be connected to the first electrical connector, where the second electrical connector comprises a second electrical connector housing comprising:

a second contact locating area for locating electrical contacts; and a second mating connector area configured to receive the mating connection area of the housing of the first electrical connector, where the mating connection areas have a same size and shape.

16. A method comprising:

inserting a portion of a first connector housing into a first mating connector area of a second connector housing; and inserting a portion of the second connector housing into a second mating connector area of the first connector housing, where the first mating connector area comprises a first wall forming a first section of the first mating connector area adjacent a first contact locating area of the first connector housing and a second wall forming a second section of the first mating connector area, where the second section is separated from the first contact locating area by the second wall, where the second mating connector area comprises a third wall forming a third section adjacent a second contact locating area of the second connector housing and a fourth wall forming a fourth section, where the fourth Section is separated from the second contact locating area by the fourth wall, where the first and second mating connection areas have a substantially same size and shape, where inserting the portion of the first connector housing into the first mating connector area of the second connector housing and inserting the portion of the second connector housing into the second mating connector area of the first connector housing comprises the fourth wall having a corner with an outwardly extending projection, where the projection extends into the fourth section, and where the projection is inserted into an outwardly extending recess into a corner of the first wall.

17. A method as in claim 16 where inserting the portion of the first connector housing into the first mating connector area of the second connector housing and inserting the portion of the second connector housing into the second mating connector area of the first connector housing comprises:

the second wall having a corner with an outwardly extending projection, where the projection extends into the second section and is inserted into an outwardly extending recess into a corner of the third wall.

18. A method as in claim 17 where inserting the portion of the first connector housing into the first mating connector area of the second connector housing and inserting the portion of the second connector housing into the second mating connector area of the first connector housing comprises:

the fourth wall having outwardly extending projections into the fourth section at two corners of the fourth wall which are inserted into outwardly extending recesses into two corners of the first wall; and the second wall having outwardly extending projections into the second section at two corners of the second wall which are inserted into outwardly extending recesses into two corner of the third wall.

19. A method as in claim 16 where inserting the portion of the first connector housing into the first mating connector area of the second connector housing and inserting the portion of the second connector housing into the second mating connector area of the first connector housing comprises the projection is surrounded by the fourth wall.

* * * * *